United States Patent [19]
Harrington et al.
[11] 4,286,814
[45] Sep. 1, 1981

[54] UNIVERSALLY PIVOTAL PADLOCK AND STAPLE SHIELDING HASP

[76] Inventors: Richard P. Harrington; Russell J. Harrington, both of P.O. Box #24, Alexandria, La. 71301

[21] Appl. No.: 840,951

[22] Filed: Oct. 11, 1977

[51] Int. Cl.[3] ..... E05C 19/08
[52] U.S. Cl. ..... 292/281
[58] Field of Search ..... 292/281–286; 70/2, 3, 4, 6, 7, 8, 9, 11, 12

[56] References Cited

U.S. PATENT DOCUMENTS 1,574,348 2/1926 Hager ..... 292/281
2,825,218 3/1958 O'Brien ..... 70/7
3,572,796 3/1971 Willner ..... 292/281

*Primary Examiner*—Richard E. Moore

[57] ABSTRACT

A universally pivotal padlock and staple shielding hasp box hinged from one end of the back side to a bolt rotatably secured through a door frame is disclosed. The hasp box having integrally connected sides and ends provides sufficient interior area to contain a padlock subject to manual external means for reciprocating the shackle between a position for trapping the staple within the hasp box and a withdrawn position freeing the staple so the hasp box can be swiveled outward and rotated down to an out of use position clear of the door opening.

23 Claims, 12 Drawing Figures

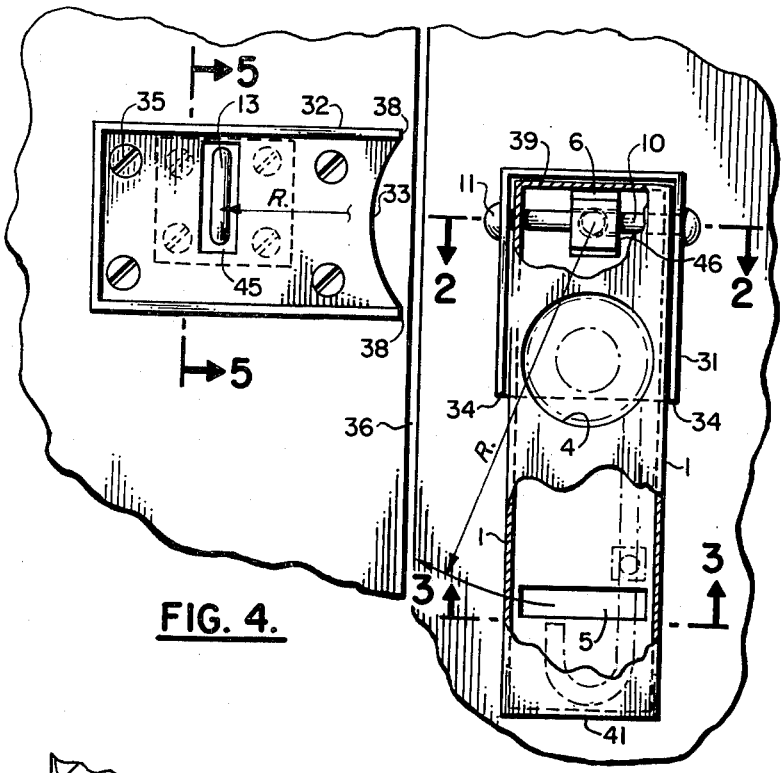
FIG. 4.
FIG. 1.
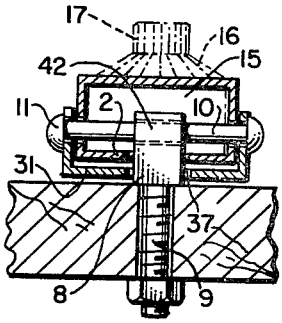
FIG. 2.
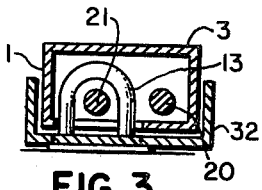
FIG. 3.
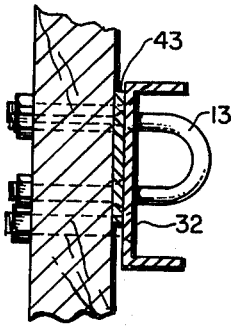
FIG. 5.
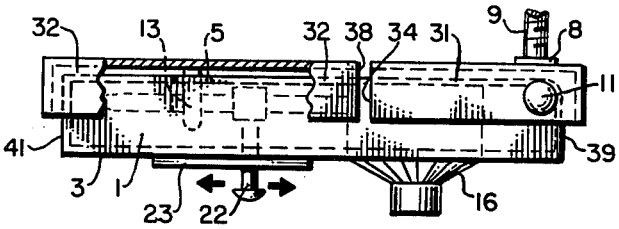
FIG. 6.
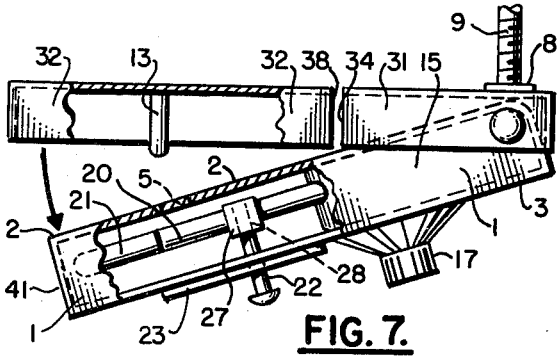
FIG. 7.

UNIVERSALLY PIVOTAL PADLOCK AND STAPLE SHIELDING HASP

This invention relates to padlock hasps in general and particularly to those undertaking to shield the securing means used in conjunction with the primary locking means.

It is an object of this invention to provide a means whereby the effectiveness of an ordinary inexpensive padlock can be enormously increased by compounding the problems encountered by pick-locks for gaining unauthorized entry where the use of padlocks is practical and commonly employed as a locking means.

It is another object and feature of this invention to provide an effective padlock locking means that neither protrudes beyond the outer edge of an open door nor extends perpendicularly outward from the surface of an unlocked or open door at any time, thereby eliminating accident hazards characteristic of standard padlock hasps in general.

It is a further object of this invention to provide a padlock locking means that is always in place and ready for instant use.

These and other objects, features, and advantages of this invention will be apparent to those skilled in the art from a consideration of this specification including the attached drawings and appended claims.

A universally pivotal padlock and staple shielding hasp is disclosed that has a specially constructed, or a standard padlock, enclosed within an elongated six-sided metal box secured at one end to door frame by a universally pivotal hinge arrangement; with an appropriate slot on the back, or door side, of said box, near the opposite and capable of receiving a metal staple secured to the door when the box is swung up into place and pushed doorwards preparatory to snapping the shackle into the lock case by sliding hingeward an external pin reciprocal in a suitable slot in the box face and secured internally to or through the long shackle leg. A close fitting cover plate as an integral part of the said pin moves with the shackle actuating pin and thus serves to coneal the slot from view and also to exclude dust, dirt and foreign particles from entering the box through the slot. The dial of a permutation (combination) lock protrudes through a provided hole in the face of the box for manipulation to and fro by the user to open the lock; whereas when use of a pin tumbler lock is desirable the box and universally pivotal hinge is designed to accommodate a key hole at hinge end of the lock and staple shielding hasp box. Three types of staple are shown which serve to cover a broad field of use, two being specifically adaptable to use of standard U-shaped padlock shackles that enter the lock case at both ends. One is adaptable to the above six-sided closed box whereby a hook is provided at box center so as to trap the shackle loop under it when the shackle is latched into the lock case by the above-mentioned shackle moving pin. A second type of shackle trapping staple is provided for use in a first closed sided box with the floor-ward side being left open so as to manually receive the short leg of the shackle after the five-sided closed hasp has been swiveled up and pushed doorward so the staple can penetrate the aforementioned slot; which special staple is provided with a lower hole for smaller locks with shorter shackle and an upper hole for larger locks with longer shackle; thus whatever size of lock is used, top of the lock case will be somewhat above the two closed sides and two closed ends of the otherwise closed box; so it is that even the open bottom hasp affords considerable protection against use of hammers, lock poppers, and hack saws characteristically used by burglars. A third type of staple is shown whereby a spherically constructed shackle has a short end that passes through the staple hole far enough to pass the far side of the aforementioned staple slot in back plate of the hasp in which case the lock must be one in which the long shackle leg is provided with a locking means. An added optional protective means is represented by two shallow cups (or troughs) one is secured to the downwardly rotatable bolt or back flange of a hinge so that the cup and hasp swing from a first position to a second position as one; however, the cross pin of the hasp permits the hasp to pivot outwardly as the two rotate together. The other half of the protective cup is secured to the door by screws, bolts or weld, to or through which the staple is fastened. These and other objects, features and advantages of this invention will be apparent to those skilled in the art from a consideration of this specification including the attached drawings and appended claims.

In the drawings:

FIG. 1 is a face view of the hasp including the protective cup of the hinge end minus an enclosed lock; however, this figure includes a clear view of the universally pivotal mechanism, a round hole in the face through which the dial of the permutation lock would protrude and an angular hole in the back plate for receiving the staple.

FIG. 2 (partly in section and partly in elevation) is a hinge end view taken along line 2—2 of FIG. 1 with the lock and dial included.

FIG. 3 (partly in section and partly in elevation) is a staple end view similar to FIG. 2 taken along line 3—of FIG. 1 with the staple and shackle of FIG. 8 also taken along line 3—3 of FIG. 8.

FIG. 4 is a front view of the staple bearing, hasp protecting cup shown secured in place to the door. (Note the radius of the staple slot of FIG. 1 and the staple of FIG. 4 are synonomous).

FIG. 5 is an end view of FIG. 4 taken along line 5—5 of FIG. 4.

FIG. 6 is a side view of FIG. 1 when it is pivoted up and pushed into a locked position with the door cup of FIG. 4.

FIG. 7 is similar to FIG. 6 shown in an unlocked and outwardly pivoted position after the lock has been dialed to open and the shackle pulled out of the staple by sliding the external pin 22 away from the hinge end as aforesaid.

Figure 8:
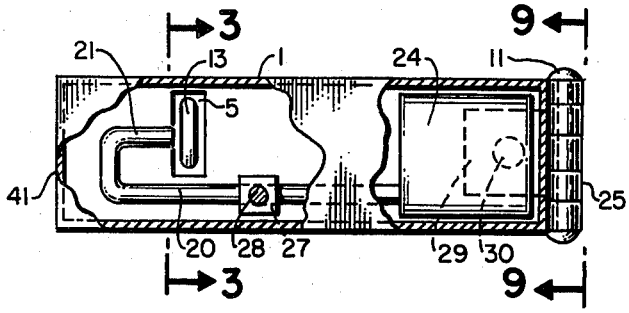

FIG. 8 (partly in section and partly in elevation) is a face view of generally the same hasp as shown and described in the previous seven figures except for the type of lock and universally pivotal hinge shown therewith; the hinge being more of the conventional type that fits flat against a surface having a central swivel bolt; also in this FIG. 8 an angular pin tumbler key lock is shown.

Figure 9:
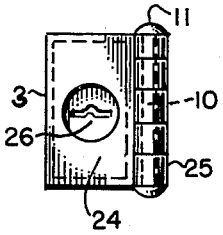

FIG. 9 is a hinge end view taken along line 9—9 of FIG. 8, which hinge pin sets back of hasp end and is off-set into the door frame or back far enough to provide ample room for the key hole as would be shown by a side view.

Figure 10:
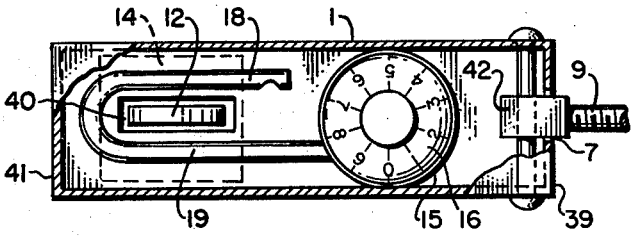

FIG. 10 is a face view of an embodiment wherein a standard lock with a standard U-shaped shackle is used and actuated by an external reciprocating locking and unlocking pin and slot cover plate as shown and described in FIG. 7 above, and mentioned in the abstract. In this instance when both legs are locked into the case the shackle loop has been trapped under an open ended hook, the design of which deviates from that of a standard staple but otherwise functions the same when closing the hasp over the staple hook; note also that the pivot pin 9 protrudes straight out from hinge end, thereby providing a deviation for mounting where nearly flush surfaces are not possible.

Figure 11:
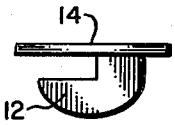

FIG. 11 is a side view of the shackle trapping hook described in FIG. 10 but is nevertheless referred to as a staple.

Figure 12:
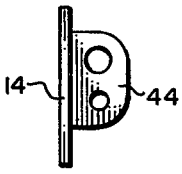

FIG. 12 is a staple designed for use in a universally pivotal hasp that has no lock encased within it; instead having an open floor-ward bottom so as to accommodate any and all standard padlocks by feeding the shackle short leg through one of the provided staple holes and snapping the shackle into the lock case in the conventional manner. The large upper hole being provided for larger locks with thicker and longer shackles; the smaller lower hole being more suitable for smaller, cheaper locks with shorter shackles. In either case the top of the padlock will be well above the outside wall of the box and thus guard it against hammer blows, chisels, hack saws, lock poppers, etc.; the open bottom hasp is therefore most suitable for various types of keylocks although it is likely certain types and sizes of dial operated locks could also be used.

The lock and staple shielding features shown in FIGS. 1 through 7 will be described first because of the hasp shielding cup; otherwise the basic function and lock shielding characteristics of all 12 figures serve the same end.

As most clearly shown in FIGS. 1-2-6 and 7 the six sided closed hasp within which the lock is housed has side plates 1, bottom plate 2, face plate 3 and end plates 39 and 41 integrally connected together to form a rectangularly shaped protective housing for the lock and shackle. Hinge pin 10 with headed ends 11 passing through the entire assembly including a free fit through square head 41 of pivot bolt 9. Pivot bolt 9 then, being of whatever length as may be required, rotatably passes through the casing to be headed on the inside after snugging its lower portion 8 against the said door casing or into a guide hole thereof after passing through enlarged hole 6 of hasp bottom 2 as can be best seen in FIG. 2. A square hole 37 is provided through the bottom of hasp-shielding cup 31 into, or through which portion 8 of head 42 presses so as to cause the hasp and cup to rotate between a vertical open position as seen in FIG. 1, and a horizontal position, where the hasp to be rotated up and swiveled back into cup 32 at FIG. 4 and/or back again. Hasp face 3 has dial hole 4 through which the dial protrudes for easy manipulation as can be seen in FIGS. 2, 3, 6 and 7 in which views the dial is shown. Back plate 2 of the hasp has open slot 5 on a common radius with staple 13 as seen in FIGS. 3 and 4; which staple passes through slot 5 seen in FIGS. 1, 6 and 7 to be penetrated by shackle stub 21 best seen in FIGS. 3 and 8; note that in FIG. 7, stub end of the specially formed shackle has not yet passed the near edge of slot 5, leaving staple 13 free to enter or leave the slot. Shackle actuating pin 22, a snug fit through sliding slot cover plate 23, passes therefrom into or through hole 28 of the long shackle leg or into a comparable hole in a fitting 27 secured to the said shackle leg 20.

After dialing the lock to open, pin 22 is moved outwards so as to pull the shackle from the lock case and thus withdraw short leg 21 from engagement with staple 13 and the inside of hasp bottom 2 so as to free the hasp for pivoting out and downward as aforesaid. To relock, the hasp is pivoted upwards, pushed in over the staple at which time pin 22 is moved hinge-ward until short leg 21 has passed through the staple and long leg 20, provided with a locking notch which snaps the shackle into a locked position; thus the staple is trapped by staple 13 within the closed hasp.

Hasp shielding cup 13 of FIG. 4 being securely fastened to the door by bolts through provided holes or welding, staple 13 may be left free to move vertically and tip forward and back as is a standard practice familiar to all manufacturers of hardware as a compensatory means for overcoming built-in inaccuracies and those that later develop. This feature is illustrated by oscillatory and reciprocal plate 43 to which staple 13 is secured as seen in FIG. 5 which view is taken along 5—5 of FIG. 4.

As the closed hasp is swung up into a locked position so as to align slot 5 of FIG. 1 with staple 13 of FIG. 4, design and installation must take into consideration corners 34 of hasp shielding cup 31 which must miss points 38 of cup 32 with ample clearance. Note in FIG. 7 that the hasp must pivot out far enough on pin 10 for hasp bottom 2 to clear lpoints 38 on cup 32 before the hasp together with cup 31 can swivel down to its out-of-engagement position as seen in FIG. 1. FIG. 6 is included here if only to illustrate the general appearance of the entire assembly when in a locked position; dial face 16, thumb knob 17 and lock case 15 also shown in FIGS. 6 and 7 to show their relative position to the rest of the assembly.

FIG. 8 for the most part is fairly well covered in the foregoing description as to function except that it is not equipped with hasp protective cups 31 and 32, which are optional in any event depending upon the particular application a user has in mind. Note however that a flat hinge-type flap 29 having a centrally located pivot hole 30 is shown as an alternate mounting means; in which case hinge pin 10 is moved out further from hasp end 39 and for illustrative purposes shows an angular key lock casing 24. In-as-much as room for a key hole is required, bolt 9 and head 42 (as seen in FIG. 2) must not only be replaced by an alternate pivoting and swiveling acting but the hinge pin 10 must be off-set to the back so as to make room for key hole 26; thus flap (or hinge end) 29 can be curled around pin 10 as shown at 25 which then can be morticed into the door. FIG. 9 is a view taken along line 9—9 of FIG. 8 which serves to clarify the foregoing.

FIG. 10 is basically identical to the other embodiments shown herewith and described herein in so far as use and external function is concerned, with shackle actuating pin 22 used in the same manner as herein above described, or some other more practical means for moving the shackle to a locked and unlocked position if so desired; also either a combination lock or a key lock may be used; the purpose of this embodiment is included herewith primarily to illustrate that a standard padlock may be used without having to either order a specially built lock nor to alter a standard lock currently being produced by dozens of existing lock companies; the hasp then can be altered so as to accommodate most any currently produced lock. Beyond showing pivotal bolt 9 protruding straight out from end 39 of the closed hasp (with clearance hole 7 provided so as to allow ample free action for a different type of mounting when flush surfaces are not possible), hook 12 as shown in FIG. 11 penetrates slot 40, which runs parallel with the shackle legs, permitting the loop of shackle legs 18 and 19 to slide under hook 12 when short leg 18 is pushed into the lock casing 15 and latched therein (locked) by moving pins 22 or by other means as above described; thus a very inexpensive or even cheap lock can be converted into a formidable barrier to illegal entry by would-be burglars. Hook 12 of FIG. 11 has mounting plate 14 provided with standard holes for securing it to a door, or this staple can be used in conjunction with hasp shielding cups 31 and 32 if so desired. If the said cups are not used, mounting plate 14 would have conventional fastening screw or bolt holes which are not shown herein.

Special staple 44 as seen in FIG. 12 also has mounting plate 14 and is designed for use in the same types of shielding hasp as herein above described with all previously explained features and functions except that the bottom (floor-ward) size of the hasp would be left open (5 closed sides). Also the hasp would be wider between bottom plate 2 and face plate 3 so as to provide greater latitude in the use of various types and sizes of padlocks (principally key locks) from small to large, thin to thick with varying lengths and sizes of shackle; but of course, thin to thick with varying lengths and sizes of shackle; but of course, it may be most practical to produce several sizes of this particular type of shielding hasp.

After swiveling the otherwise closed hasp up from a first, out of use, position as seen in FIG. 1, to a second horizontal position whereby slot 5 would be in alignment with staple 44 occupying the same general location as staple 13 as seen in FIG. 4, the hasp is pivoted doorward causing staple 44 to penetrate slot 5 as previously described. The open padlock shackle short leg is turned around to a point diametrically opposite from its normal locking position; at which time said short leg is fed through whichever of the two provided (upper and lower) holes as may cause the lock top to be well above the lock and shackle shielding outer face plate (3) of the hasp after the padlock case is turned back around 180 degrees and pushed upward so as to latch both shackle legs into the padlock case.

In as much as the above described process of feeding the short shackle leg through the staple would require more lengthwise space to accomplish than is shown between slot 5 and hasp end 41, the hasp would either have to be built longer so as to provide this needed space, or slot 5 and staple 44 could be moved further hingeward towards hasp end 39. In any event, both the shackle and lock top would be amply protected against hammer blows, chisels, hack saws, lock poppers and other sophisticated means commonly used by burglars for opening unprotected standard padlocks.

As a closing statement of the above disclosure it is apparent that the various embodiments shown and described are basically designed to accommodate not only specially built locks if so desired, but also to provide a means whereby any padlocks currently produced by numerous companies may be used; however, certain types of locks other than padlocks may well be adapted for use in the above described hasp embodiments by slightly altering either or both the lock and hasp.

From the foregoing, it will be seen that this invention is one well-adapted to attain all of the ends and objectives hereinabove set forth, together with other advantages which are obvious and which are inherent to the apparatus. It will be understood that certain features and variations are of utility and may be employed without reference to other features and variations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is given below.

We claim:

1. A hasp comprising a housing formed so that a padlock may be inserted therein and shielded thereby, a means at one end of the housing for mounting said housing on a surface for pivotal movement both along said surface and away therefrom, access means through said housing for manipulation of a padlock, when inserted therein, and for reception of a staple; and a staple formed to be secured by the shackle of a padlock, when inserted into said access means, and having means for mounting the staple, for entry into said housing through said access means.

2. The hasp of claim 1, wherein said access means includes a key opening for unlocking a key-operated padlock.

3. The hasp of claim 2, wherein said key opening is at the end of said housing adjacent said means for mounting said housing for pivotal movement.

4. The hasp of claim 1 wherein said access means includes an opening shaped to accomodate a dial of a combination lock.

5. The hasp of claim 1, wherein said access means includes an elongated opening for reception of a handle means on the padlock shackle.

6. The hasp of claim 1, wherein said staple is in the form of an eye formed by a loop formed to receive a leg of a padlock shackle.

7. The hasp of claim 1, wherein said staple is in the form of a hook shaped to receive thereunder a padlock shackle.

8. The hasp of claim 1, wherein said means for mounting said housing for pivotal movement comprises a hinge pin secured to said housing, and a mounting pin pivotally connected to said hinge pin, said mounting pin formed to be pivotally secured through said surface and normal thereto.

9. The hasp of claim 1, wherein at least one cup having a bottom and sidewalls is associated with one of said hasp and staple, the sidewalls thereof being shaped to shield and closely receive the walls of said housing when said housing is positioned adjacent said surface.

10. The hasp of claim 9, wherein two housing shielding cups are provided, one mounted around said staple, and the other around the means for providing the housing for pivotal movement.

11. The hasp of claim 9, wherein said cup is secured around the means for mounting the housing for pivotal movement, and is associated with said means so that it pivots with said housing along said surface.

12. The hasp of claim 11, wherein said means includes a hinge pin which extends through said housing and through the sidewalls of said cup.

13. The hasp of claim 1, including a padlock in said housing, arranged so that the padlock can be manipulated through said access means.

14. The hasp of claim 12, wherein a shackle of said padlock has secured thereon a handle means which extends through an elongated opening in said housing to provide manual control of said shackle.

15. A hasp comprising an elongated closed in six-sided lock shielding hasp, a swivel bolt secured at 90 degrees relative to a hinge pin at one end of said hasp for providing a universally pivotal means for mounting and swinging the hasp between an out of use vertical position to a horizontal locking position, a slot in the back side of the hasp, a staple having a common radius with the slot so as to enter the slot when the hasp is pivoted up from a first out of use position to a second locking position, a shackle type lock securely enclosed within the hasp, a shackle of the lock capable of passing under or through a staple so as to trap the staple within the hasp when the shackle is latched into the lock casing, an external means extending into the hasp for manually moving the shackle between a locked and unlocked position and vice versa when the hasp is closed over the staple.

16. The hasp of claim 15 further provided with a hole in its face through which the dial of a combination lock protrudes for easy manipulation of the tumblers or disks to align the gates with the fence preparatory to opening the lock.

17. The hasp of claim 15, wherein said external means comprises a pin secured to a long leg of said lock shackle and extending through a longitudinal slot in a side of said hasp so as to cause the pin, cover plate and shackle to reciprocate as one for moving the shackle in and out of the lock case for trapping of the staple by the shackle within the hasp or freeing the staple from the shackle after the lock has been prepared for opening.

18. The hasp of claim 17 whereby said pin is secured within the hasp to the center portion of a sturdy spring, the opposite ends of which are then secured to the shackle for moving the shackle into its two positions of being locked and unlocked, thus safeguarding the actuating pin from being forced and subsequently damaged whenever the shackle is not free to be moved.

19. The hasp of claim 15 whereby only a long leg of said shackle latches into the lock casing, the opposite shackle leg being turned sharply back toward the lock casing in the form of a stubby short leg only long enough to pass through the staple hole well beyond the staple entry slot in the back side of the hasp; thus when the shackle is securely latched within the lock casing the said stub shackle leg traps the staple within the back plate of the hasp; conversely when the shackle is fully withdrawn from the lock casing the said stub side of the shackle amply clears the slot for free ingress and egress of the staple.

20. The hasp of claim 15 wherein a hinge leaf normally underlies said hasp and forms a hinge with said hinge pin and hasp, said hinge pin being offset, accomodating a key lock mounted at a key hole in said hasp adjacent said hinge pin, said swivel bolt being a flat headed screw bolt extending through a hole in a back plate of a protective cup and rotatably secured relative to the door casing for swivelling the hasp down out of the door opening.

21. The hasp of claim 15 having an enclosed standard dial operated combination for aligning the tumbler gates with the fence and also having a standard U-shaped shackle whereby both the long and short legs enter and latch into the lock casing through use of a latching notch on at least one leg of the shackle, the staple being a hook forward to receive the looped end of the shackle under it, between the staple hook and back plate of the hasp, when the shackle legs are moved into the lock case and latched therein; when then the lock is dialed to open the shackle legs can be moved fully out of the lock case with the shackle loop moved out of engagement with the staple hook which is then free to be moved either in or out of the slot in back plate of the hasp; thus a very cheap lock can be turned into a formidable barrier to restrain burglars from illegal entry.

22. The hasp of claim 15 whereby the bottom of the hasp is left open for use with various sizes of key operated padlocks by turning the shackle 180 degrees from locking position for feeding through a staple having two holes, the lower hole being most suitable for smaller, less expensive locks with shorter shackle length, the upper hole being more suitable for larger padlocks having longer shackle length, in either case when the lock case is turned back to locking position and pushed upwards so as to latch the shackle legs into the case, both the shackle and case top will be well above the lower edge of the face plate of the hasp; thus protecting both shackle and lock top from hammer blows, chisels, hack saws, lock poppers and other sophisticated means employed by pick locks for gaining illegal entry.

23. The hasp of claim 15 wherein a cup having bottom, side portions and end is provided one secured to the hasp and one secured to said staple, said hasp cup being secured to a square head of said swivel bolt so that the hasp and cup swivel together, and extending up to or past half the thickness of the hasp, the staple cup being secured to a door with the staple free to oscillate and reciprocate sufficiently so as to compensate for inaccuracies of installation and settling of buildings; thus the hasp itself is protected against chisels, pinch bars, etc.

* * * * *